US007857717B2

(12) United States Patent
Martin

(10) Patent No.: US 7,857,717 B2
(45) Date of Patent: Dec. 28, 2010

(54) HOCKEY STICK APPARATUS FOR STICK HANDLING TRAINING AND METHODS OF STICK HANDLING TRAINING

(76) Inventor: Jean-Maurice Martin, 144 Endeavour Dr., Cambridge, ON (CA) N3C 4C9

( * ) Notice: Subject to any disclaimer, the term of this patent is extended or adjusted under 35 U.S.C. 154(b) by 36 days.

(21) Appl. No.: 12/273,489

(22) Filed: Nov. 18, 2008

(65) Prior Publication Data

US 2010/0125010 A1 May 20, 2010

(51) Int. Cl.
*A63B 59/14* (2006.01)

(52) U.S. Cl. ..... 473/446; 473/560; 473/562

(58) Field of Classification Search ..... 473/446, 473/560–563

See application file for complete search history.

(56) References Cited

U.S. PATENT DOCUMENTS

| | | | | |
|---|---|---|---|---|
| 1,305,952 | A | 6/1919 | Suesman | |
| 3,804,413 | A | 4/1974 | Hrivnak | |
| 3,834,714 | A | 9/1974 | Smolinski | |
| 5,011,145 | A | 4/1991 | Bartkowicz | |
| 5,263,711 | A | 11/1993 | Addis et al. | |
| 5,413,339 | A * | 5/1995 | Martin | 473/295 |
| 5,609,336 | A * | 3/1997 | Tashjian | 473/560 |
| 5,816,961 | A | 10/1998 | Kraemer | |
| 5,967,913 | A | 10/1999 | Sulenta | |
| 6,004,234 | A * | 12/1999 | Majchrowicz | 473/560 |
| 6,033,327 | A | 3/2000 | Bird | |
| 6,113,508 | A | 9/2000 | Locarno et al. | |
| 6,248,031 | B1 | 6/2001 | Brodie | |
| 6,257,997 | B1 * | 7/2001 | Doble et al. | 473/516 |
| 6,361,451 | B1 * | 3/2002 | Masters et al. | 473/318 |
| 6,419,601 | B1 | 7/2002 | Kenner | |
| 7,070,524 | B1 | 7/2006 | Garvey | |

(Continued)

FOREIGN PATENT DOCUMENTS

| | | |
|---|---|---|
| CA | 2093854 | 10/1994 |

(Continued)

OTHER PUBLICATIONS

PCT International Search Report (International Application No. PCT/CA2009/001661), Mail Date: Jan. 26, 2010, Unpublished.

(Continued)

*Primary Examiner*—Mark S Graham
(74) *Attorney, Agent, or Firm*—Bereskin & Parr LLP

(57) ABSTRACT

A hockey stick for training a person in stick handling, having elongate upper stick portion, an elongate lower stick portion, an elongate coupling member, and an elongate middle stick portion. The elongate upper stick portion is configured to be gripped by a control hand of the person. The elongate lower stick portion has a blade member extending outwardly therefrom. The elongate coupling member rigidly couples the upper stick portion to the lower stick portion. The elongate middle stick portion is positioned between and collinear with the upper stick portion and the lower stick portion and is configured to be gripped by a directional hand of the person. The middle stick portion is rotatably coupled to the elongate coupling member so that rotation of the upper stick portion causes the lower stick portion and the blade member to rotate without rotating the middle stick portion gripped by the directional hand.

20 Claims, 9 Drawing Sheets

U.S. PATENT DOCUMENTS

| | | | | |
|---|---|---|---|---|
| 7,282,001 | B2 | 10/2007 | Ponzini | |
| 2001/0041626 | A1 | 11/2001 | Madelle et al. | |
| 2003/0144071 | A1* | 7/2003 | Dodge et al. | 473/316 |
| 2003/0144089 | A1* | 7/2003 | Ryan | 473/457 |
| 2005/0187046 | A1* | 8/2005 | Kavanaugh | 473/560 |
| 2006/0122013 | A1 | 6/2006 | Dodge et al. | |
| 2006/0217218 | A1 | 9/2006 | Ponzini | |
| 2007/0066456 | A1 | 3/2007 | Kim | |
| 2008/0248902 | A1 | 10/2008 | Pittorf | |
| 2008/0318713 | A1 | 12/2008 | Beach | |
| 2009/0293339 | A1* | 12/2009 | Bartholomew | 43/18.1 R |

FOREIGN PATENT DOCUMENTS

| | | |
|---|---|---|
| CA | 2204176 | 11/1997 |
| CA | 2308569 | 11/2000 |
| CA | 2435145 | 1/2005 |

OTHER PUBLICATIONS

PCT Written Opinion of the International Searching Authority (International Application No. PCT/CA2009/001661), Mail Date: Jan. 26, 2010, Unpublished.

* cited by examiner

HOCKEY STICK APPARATUS FOR STICK HANDLING TRAINING AND METHODS OF STICK HANDLING TRAINING

TECHNICAL FIELD

The teachings disclosed herein relate to hockey training, and in particular to hockey stick apparatus for stick handling training and methods of stick handling training.

BACKGROUND

Hockey has become a highly specialized sport, and requires specialized skills to play at all levels. One specialized skill relates to the ability to control a game element (e.g. a puck or ball) during play, also known as "stick handling". Stick handling involves manipulation of the hockey stick to control the game element as the hockey player moves about on the playing surface. For example, by moving an ice hockey stick when playing ice hockey, a hockey player can use the blade of the stick to control the movement of a puck on the ice surface. Stick handling is generally an important skill for shooting, passing and generally controlling possession of the game element.

According to some stick handling techniques, hockey players are taught to use their upper hand as a control hand to control the angle and rotational position of the blade of the hockey stick to move the puck or ball, while the lower hand is used as a directional hand to change the overall orientation of the stick without rotating the stick.

There is a need in the art for improved apparatus and methods for stick handling training for hockey.

SUMMARY

According to one aspect of the invention there is provided a hockey stick for training a person in stick handling, comprising an elongate upper stick portion configured to be gripped by a control hand of the person, an elongate lower stick portion having a blade member extending outwardly therefrom, an elongate coupling member rigidly coupling the upper stick portion to the lower stick portion, and an elongate middle stick portion positioned between and collinear with the upper stick portion and the lower stick portion and configured to be gripped by a directional hand of the person, the middle stick portion being rotatably coupled to the elongate coupling member so that rotation of the upper stick portion causes the lower stick portion and the blade member to rotate without rotating the middle stick portion gripped by the directional hand.

The upper stick portion and the middle stick portion may be sized and shaped such that the control hand and the directional hand may be spaced apart by an operational distance during use. In some embodiments, the operational distance may be greater than about 6 inches.

In some embodiments, the upper stick portion and the middle stick portion may each have generally matching rectangular outer stick profiles.

In some embodiments, the middle stick portion comprises at least one coupling guide sized and shaped to rotatably engage the coupling member therein.

In some embodiments, the upper stick portion has an upper insert therein configured to securely engage a first end of the coupling member, and the lower stick portion has a lower insert therein configured to securely engage a second end of the coupling member so as to rigidly couple the upper stick portion to the lower stick portion. The lower insert may have a first friction-reduced bushing portion protruding outwardly from the lower stick portion, and the first coupling guide may have a second friction-reduced bushing portion protruding outwardly from the lower end of the middle stick portion, wherein the first and second bushing portions are configured to slidably engage with each other to facilitate rotation of the lower stick portion with respect to the middle stick portion.

In some embodiments, the upper insert has a third friction-reduced bushing portion protruding outwardly from the upper stick portion, and the second coupling guide has a fourth friction-reduced bushing portion protruding outwardly from the upper end of the middle stick portion, wherein the third and fourth bushing portions are configured to slidably engage with each other to facilitate rotation of the upper stick portion with respect to the middle stick portion.

In some embodiments, the lower insert is permanently secured to the lower stick portion and the upper insert is permanently affixed to the upper stick portion. In other embodiments, the lower insert is removably secured to the lower stick portion and the upper insert is removably secured to the upper stick portion. In yet other embodiments, the upper insert is integral with the upper stick portion, and the lower insert is integral with the lower stick portion.

In some embodiments, the middle stick portion further comprises at least one coupling guide integral therewith, the at least one coupling guide being sized and shaped to rotatably engage the coupling member therein.

In some embodiments, the upper stick portion has an upper gripping portion configured to receive the control hand, and the middle stick portion has a middle gripping portion configured to receive the directional hand, the upper and middle gripping portions sized and shaped such that the control hand and the directional hand may be spaced apart by an operational distance during use.

The coupling member may be a rod member having at least one portion with a cylindrical outer profile. The middle stick portion may be at least 12 inches long, and the upper stick portion may be at least 4 inches long.

According to another aspect of the invention, there is provided a hockey stick for training a person in stick handling, comprising an elongate upper stick portion configured to be gripped by a control hand of the person, an elongate lower stick portion rigidly coupled to the upper stick portion, the lower stick portion having a blade member extending outwardly therefrom, and an elongate middle stick portion positioned between and collinear with the upper stick portion and the lower stick portion and configured to be gripped by a directional hand of the person, the middle stick portion being rotatably coupled to the upper stick portion and lower stick portion so that rotation of the upper stick portion causes the lower stick portion and the blade member to rotate without rotating the middle stick portion gripped by the directional hand.

The hockey stick may further comprise an elongate coupling member for rigidly coupling the upper stick portion to the lower stick portion, the middle stick portion having a bore therein for receiving the coupling member.

In some embodiments, the upper stick portion has an upper length and the middle stick portion has a middle length, the upper length and middle length selected such that the control hand and the directional hand may be spaced apart by an operational distance during use.

According to another aspect of the invention, there is provided a rotational assembly for use with a hockey stick, comprising a lower insert sized and shaped to be received in a first hollow portion of a lower stick portion of the hockey stick, an upper insert sized and shaped to be received in a second hollow portion of an upper stick portion of the hockey stick, an elongate coupling member rigidly coupled to the lower insert and the upper insert, and an elongate middle stick portion rotatably coupled to the coupling member so that, when the upper insert is received in the upper stick portion and the lower insert is received in the lower stick portion, rotation of the upper stick portion causes the lower stick portion to rotate without rotating the middle stick portion.

According to yet another aspect of the invention, there is provided a method of stick handling training, comprising providing a hockey stick having an elongate upper stick portion, an elongate lower stick portion rigidly coupled to the upper stick portion and having a blade member extending outwardly therefrom, and an elongate middle stick portion positioned between and collinear with the upper stick portion and the lower stick portion, the middle stick portion being rotatably coupled to the upper stick portion and the lower stick portion, gripping the upper stick portion using a control hand, gripping the middle stick portion using a directional hand, rotating the upper stick portion in a first direction using the control hand, causing the lower stick portion and the blade member to rotate in the same first direction, and inhibiting the middle stick portion from rotating using the directional hand

BRIEF DESCRIPTION OF THE DRAWINGS

The drawings included herewith are for illustrating various examples of systems, methods, and apparatuses of the present specification and are not intended to limit the scope of what is taught in any way. In the drawings.

DETAILED DESCRIPTION

Figure 1:
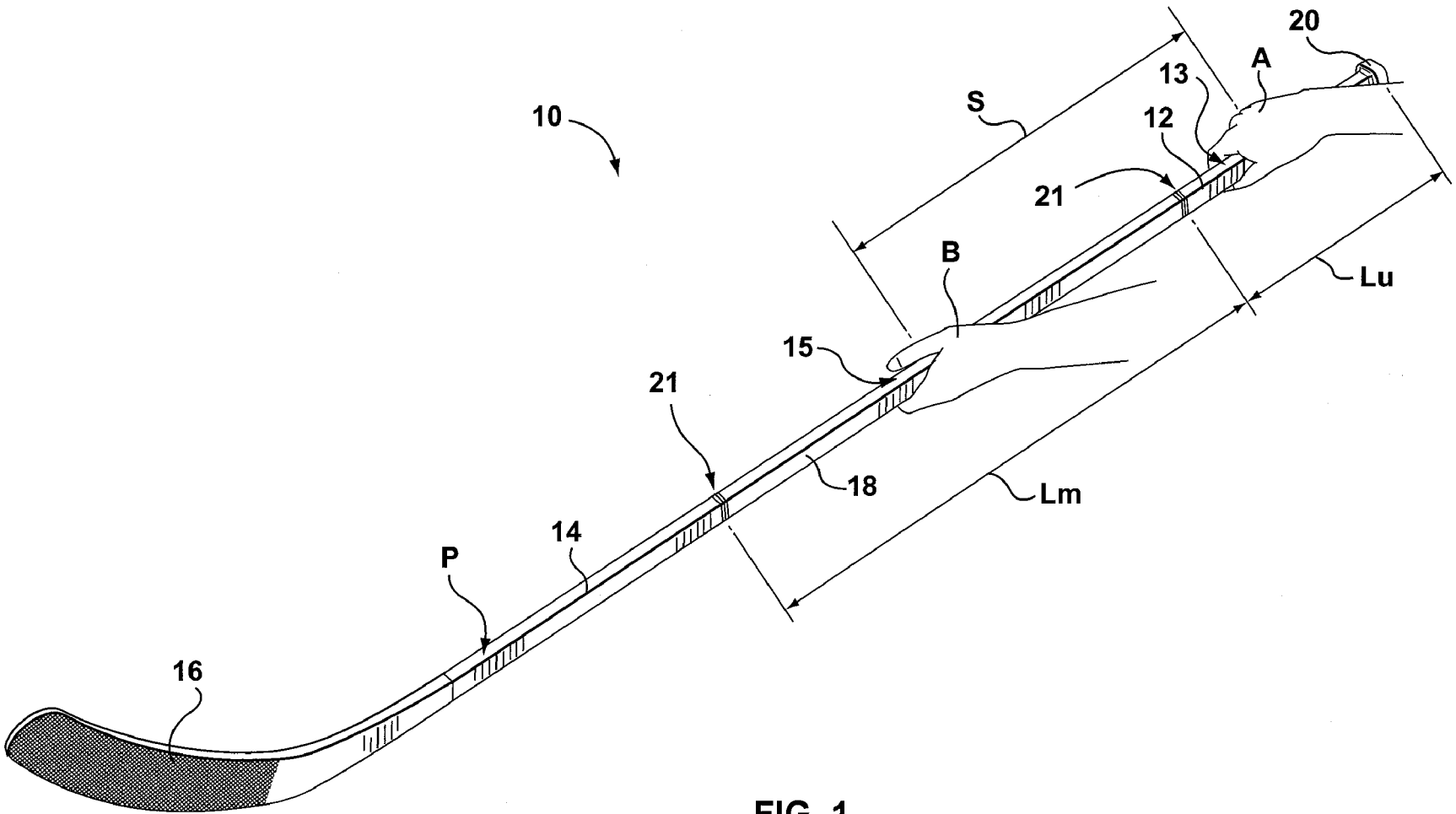
FIG. 1 is a perspective view of a hockey stick for training a person in stick handling according to one embodiment of the invention.

Turning to FIG. 1, illustrated therein is a hockey stick 10 for training a person in stick handling according to one embodiment of the invention.

The hockey stick 10 generally includes a generally elongate upper stick portion 12, a generally elongate lower stick portion 14 having a blade member 16 extending outwardly therefrom, and a generally elongate middle stick portion 18 positioned between the upper stick portion 12 and the lower stick portion 14. As shown, the middle stick portion 18 is also collinear with the lower stick portion 14 and the upper stick portion 12.

The upper stick portion 12 is generally configured to be gripped by a first hand or control hand A of the person training in stick handling. For example, as shown in FIG. 1, the person is using their right hand as the control hand A by gripping a gripping portion 13 of the upper stick portion 12. As will be described in greater detail below, the control hand A may be used to control the angle and rotational position of the blade member 16 of the hockey stick 10 to move a game element (e.g. a puck or ball).

Similarly, the middle stick portion 18 is configured to be gripped by a second hand or directional hand B of the person training in stick handling. For example, as shown in FIG. 1, the person is using their left hand as the directional hand B by gripping a gripping portion 15 of the middle stick portion 18. As will be described in greater detail below, the directional hand B may be used to change the overall orientation of the hockey stick 10 (e.g. the position of the hockey stick 10 with respect to the person) without rotating the blade member 16.

As detailed below, the lower stick portion 14 and the upper stick portion 12 are rigidly coupled together, while the middle stick portion 18 is rotatably coupled to the upper stick portion 12 and the lower stick portion 14.

Figure 2:
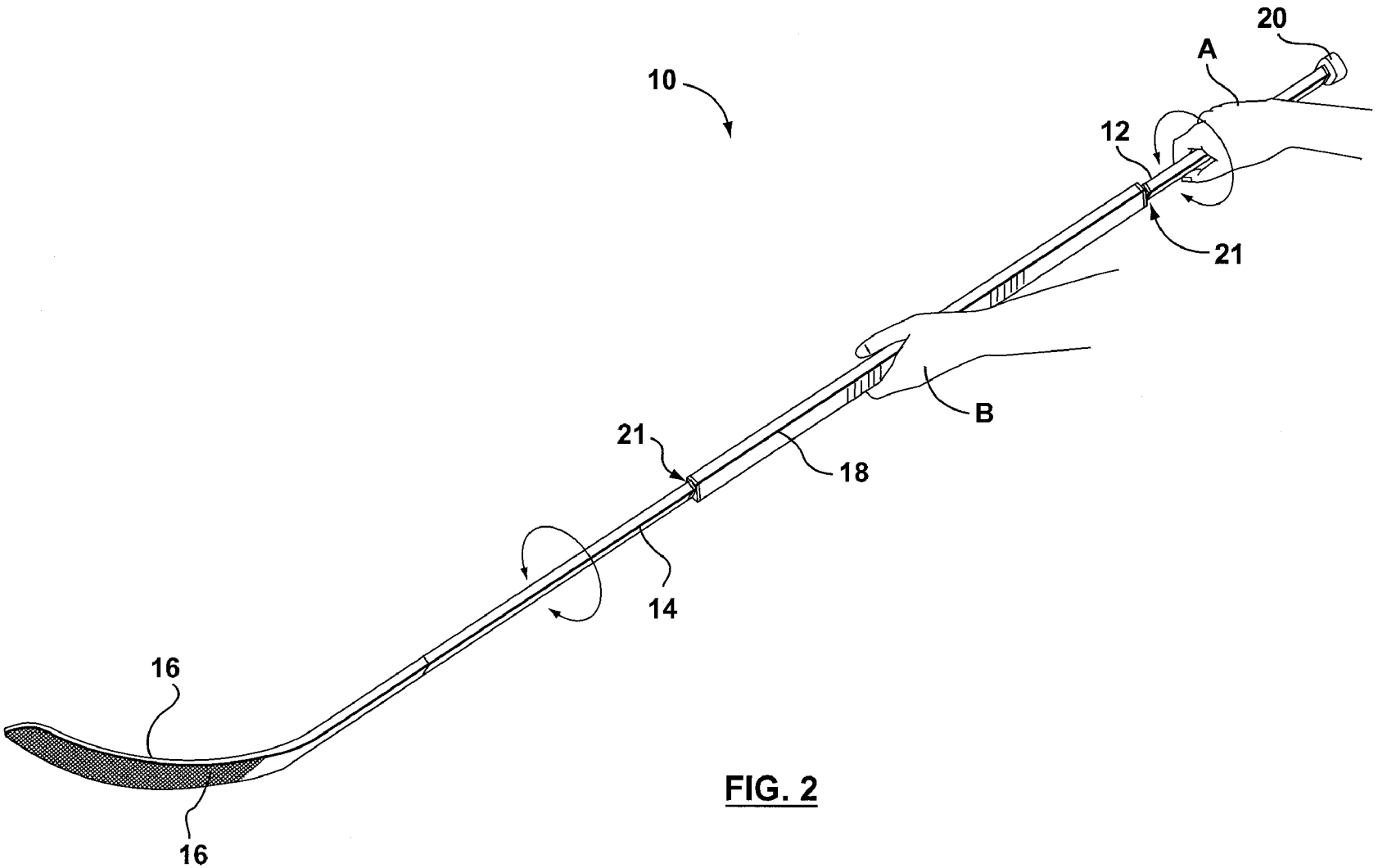
FIG. 2 is a perspective view of the hockey stick of FIG. 1 shown with the upper stick portion and lower stick portion in a rotated orientation.

During use, the person training in stick handling can use their control hand A to rotate the upper stick portion 12 of the hockey stick 10. The rotation of the upper stick portion 12 causes the lower stick portion 14 and the blade member 16 to rotate in the same direction, as shown for example in FIG. 2. However, as the middle stick portion 18 is rotatably coupled to the lower stick portion 14 and upper stick portion 12, the directional hand B gripping the middle stick portion 18 generally inhibits the middle stick portion 18 from rotating.

In this manner, the hockey stick 10 may be useful as a training tool for stick handling, as it tends to teach the person using the stick 10 to control the rotational movement of the blade member 16 using the control hand A and without using the directional hand B. The blade member 16 can therefore be used to control the movement of a game element (e.g. a puck or ball).

In some embodiments, the upper stick portion 12 and lower stick portion 14 are freely rotatable with respect to the middle stick portion 18 such that little or no gripping force must be applied by the directional hand B to inhibit rotation of the middle stick portion 18.

In other embodiments, the rotation of the middle stick portion 18 may be partially restricted or resisted (for example due to drag or frictional forces generated between the rotating upper stick portion 12, the middle stick portion 18, and the lower stick portion 14) such that the directional hand B must apply a non-trivial gripping force to inhibit the rotation of the middle stick portion 18.

As shown in FIG. 1, the upper stick portion 12 and the middle stick portion 18 are generally sized and shaped so that during use the control hand A and the directional hand B may be spaced apart by an operational distance S selected as appropriate for proper stick handling training.

It will be understood that the operational distance S may vary in different circumstances. For example, different persons (e.g. youth or adults) using the stick may prefer different operational distances S between the control hand A and the directional hand B when using the hockey stick 10. Furthermore, the same person may choose to vary the operational distance S between the control hand A and the directional hand B during use, for example to provide a different stick handling feel.

In some embodiments the operational distance S may be greater than about 3 inches. In other embodiments the operational distance S may be greater than about 6 inches. In other embodiments, the operational distance S may greater than about 12 inches. In yet other embodiments, the operational distance S may be between about 3 inches and 24 inches.

As shown, the upper stick portion 12 has an upper length Lu and the middle stick portion 18 has a middle length Lm. The upper length Lu and middle length Lm may be selected so that the operational distance S provides a predetermined spacing between the control hand A and the directional hand B to inhibit interference therebetween when the person is using the hockey stick 10 for stick handling training.

For example, in some embodiments, the upper length Lu may be between about 3 inches and 20 inches. In other embodiments, the upper length Lu may be between about 8 inches and 16 inches. In yet other embodiments, the upper length Lu may be between about 10 inches and 12 inches. In yet other embodiments, the upper length Lu is at least 6 inches.

In some embodiments, the middle length Lm may be between about 6 inches and 36 inches. In other embodiments, the middle length Lm may be between about 12 inches and 30 inches. In yet other embodiments, the middle length Lm may be between 18 inches and 27 inches. In yet some other embodiments, the middle length Lm may be about 24 inches. In yet other embodiments, the middle length Lm may be at least 12 inches.

Figure 6:
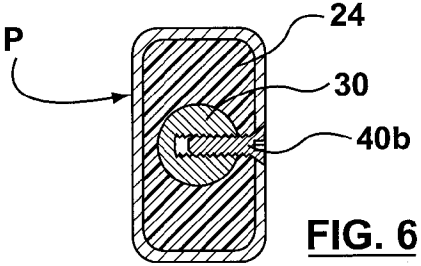
FIG. 6 is a cross sectional view of the hockey stick of FIG. 4 taken along line 6-6.

In some embodiments, as shown in FIGS. 1 and 6, one or more of the upper stick portion 12, the lower stick portion 14 and the middle stick portion 18 have rectangular outer stick profiles indicated generally as P. The outer stick profiles P may be selected so that the hockey stick 10 has a similar outer profile or appearance to a conventional hockey stick. Thus, the hockey stick 10 tends to be useful as a training tool as the outer profile P of the hockey stick 10 tends to mimic the outer profile of conventional hockey sticks.

In some embodiments, the hockey stick 10 may also include a knobbed portion 20 at the upper end of the upper stick portion 12 (generally at the end of the hockey stick 10 opposite from the blade 16). The knobbed portion 20 may be formed integrally with the hockey stick 10 or may be built up by the application of tape or another material to the hockey stick 10. The knobbed portion 20 may make it easier to pick up the stick 10 if dropped, as it tends to create a small gap between the upper stick portion 12 and the playing surface. Furthermore, the knobbed portion 20 may assist a person using the hockey stick 10 in gripping the upper stick portion 12 with the control hand A.

Figure 3:
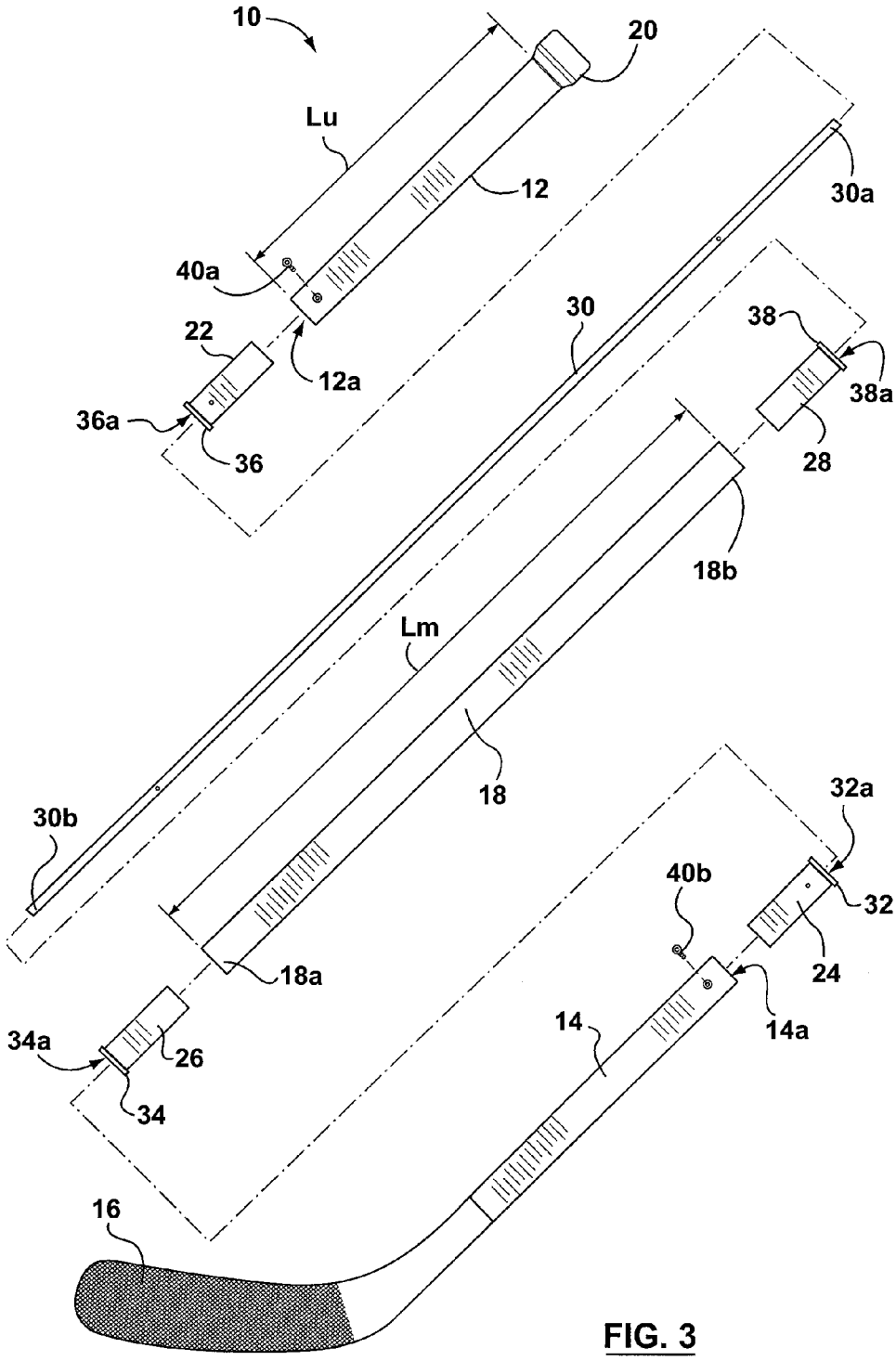
FIG. 3 is an exploded view of the hockey stick of FIG. 1.

Turning now to FIGS. 3 to 7, the construction of the hockey stick 10 according to the illustrated embodiment will be described in greater detail. As shown in FIG. 3, in some embodiments the hockey stick 10 may be made of a plurality of components that can be assembled together (e.g. the upper and lower stick portions 12, 14 may be coupled together using a rotational assembly therebetween). In particular, the upper stick portion 12, the lower stick portion 14 and middle stick portion 18 may be discrete components that are coupled together at rotatable coupling joints 21.

As shown, the hockey stick 10 may include an upper insert 22 that sized and shaped to be securely received in an upper hollow portion 12*a* of the upper stick portion 12, and a lower insert 24 sized and shaped to be securely received in a lower hollow portion 14*a* of the lower stick portion 14. The upper and lower inserts 22, 24 may tend to act as reinforcement portions within the upper and lower stick portions 12, 14. Furthermore, as described below, the upper and lower inserts 22, 24 are generally used to secure the upper stick portion 12 and lower stick portion 14 together.

The hockey stick 10 may also include a rigid coupling member 30, which may be shaped as a shaft or rod. The coupling member 30 is generally sized and shaped so as to pass through a bore 18*c* of the middle stick portion 18 when the stick 10 is assembled. Accordingly, a first end 30*a* of the coupling member 30 may be rigidly secured to the upper insert 22, while a second end 30*b* of the coupling member may be rigidly secured to the lower insert 24. In this manner, the coupling member 30, upper insert 22 and lower insert 24 cooperate so as to rigidly couple the upper stick portion 12 to the lower stick portion 14.

Generally, the coupling member 30 can be secured to the upper insert 22 and lower insert 24 in any suitable manner. For example, as shown in FIG. 6, the coupling member 30 may be secured to the lower insert 22 using at least one fastener 40*b*, such as a screw that is threadably engaged in a cross-drilled hole provided in the lower stick portion 14, the lower insert 22 and the coupling member 30.

In other embodiments, the coupling member 30 may be secured to the upper and lower inserts 22, 24 using locking tabs, adhesives, by press-fitting the coupling member 30 into the inserts 22, 24, or according to any other suitable technique.

In some embodiments, the coupling member 30 may be made of any suitable rigid material, for example a metal (e.g. aluminum or steel), a suitable plastic (e.g. an ultra high molecular weight polyethylene (UHMW PE) or a polyoxymethylene such as Derlin™), or a composite (e.g. a carbon fiber, an aramid, or fiberglass).

As shown in FIG. 3, the rigid coupling member 30 generally has a length greater than the middle length Lm of the middle stick portion 18 such that the first end 30*a* extends into the upper stick portion 12 and the second end 30*b* extends into the lower stick portion 14.

The coupling member 30 generally has at least one portion with a cylindrical outer profile such that the middle stick portion 18 may be rotatably engaged thereto as will be described in detail below. For example, as shown the coupling member 30 may be a cylindrical rod member with a cylindrical outer profile along the length thereof.

Figure 7:
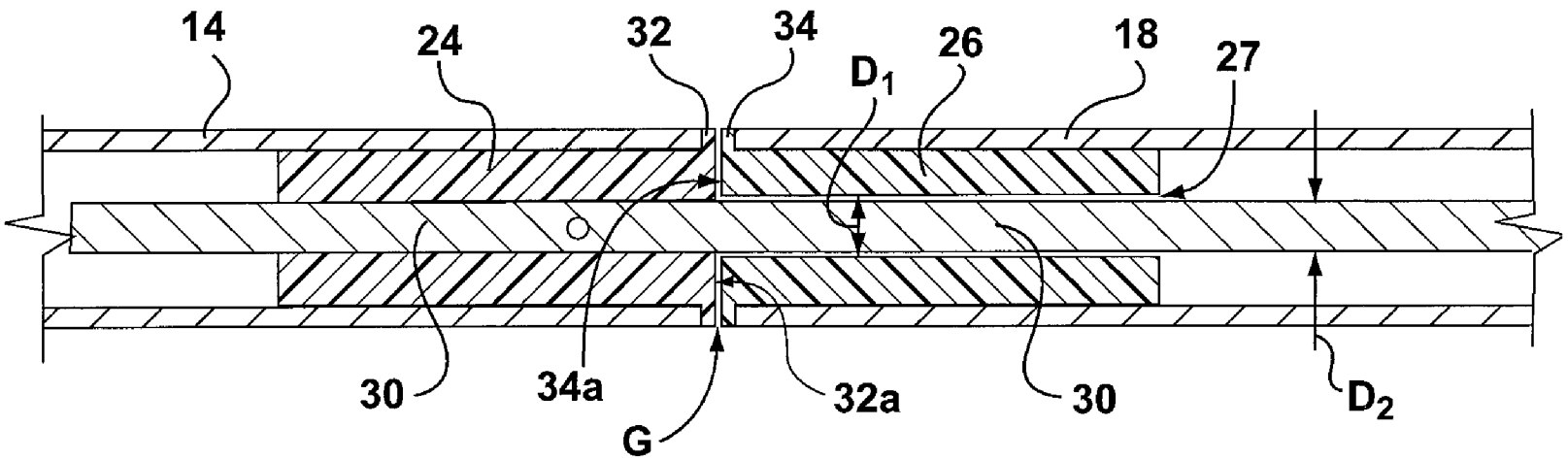
FIG. 7 is a close up detail view of the middle stick portion and the lower stick portion of the hockey stick of FIG. 1.

The hockey stick 10 may include a first coupling guide 26 sized and shaped to be received in a lower end 18*a* of the middle stick portion 18, and a second coupling guide 28 sized and shaped to be received in an upper end 18*b* of the middle stick portion 18. Generally, the first and second coupling guides 26, 28 each have a bore therein sized and shaped to receive the outer profile of the coupling member 30, allowing the middle stick portion 18 to be rotatably engaged to the coupling member 30. For example, as shown in FIG. 7, the first coupling guide 26 may have a cylindrical bore 27 with a first diameter D1 sized slightly larger than the diameter D2 of the cylindrical coupling rod.

In this manner, as the coupling member 30 is used to rotate the lower stick portion 14, the coupling guides 26, 28 allow the coupling member 30 to rotate so that the directional hand B may inhibit the middle stick portion 18 from rotating.

Generally, the various components of the hockey stick 10 may be made using any suitable materials that are known in the art of manufacturing hockey sticks. For example, in some embodiments, any one or more of the upper stick portion 12, the lower stick portion 14, the blade member 16 and the middle stick portion 18 may be made of wood, aluminum, fiberglass, plastic, extruded composites, laid-up composites (e.g. carbon fiber, or aramids such as Kevlar™), and titanium, or any combination thereof.

The upper insert 22, the lower insert 24, and the first and second coupling guides 26, 28 may be made of any suitable material. For example, in some embodiments, any one or more of the upper insert 22, the lower insert 24, and the first and second coupling guides 26, 28 may be made of wood, aluminum, fiberglass, plastic (e.g. ultra high molecular weight polyethylene (UHMW PE), extruded composites, and titanium, or any combination thereof.

Turning now specifically to FIGS. 3 and 7, in some embodiments the lower insert 24 may include a friction-reduced first bushing portion 32 that protrudes outwardly from the lower stick portion 14. In some embodiments, the first coupling guide 26 may also have a friction-reduced second bushing portion 34 protruding outwardly from the lower end 18*a* of the middle stick portion 18. During use of the hockey stick 10, the first bushing portion 32 tends to slidably engage with the second bushing portion 34 so as to inhibit frictional forces therebetween, thus facilitating rotation of the lower stick portion 14 with respect to the middle stick portion 18. For example, the first bushing portion 32 may have a first bushing surface 32*a* configured to slidably engage with a second bushing surface 34*a* on the second bushing portion 34.

Similarly, as shown in FIG. 3, the upper insert 22 may have a friction-reduced third bushing portion 36 protruding outwardly from the upper stick portion 12, and the second coupling guide 28 may have a friction-reduced fourth bushing portion 38 protruding outwardly from the upper end 18*b* of the middle stick portion 18*b*. Similar to as described above, during use of the hockey stick 10, the third bushing portion 36 tends to slidably engage with the fourth bushing portion 38 so as to inhibit frictional forces therebetween, thus facilitating rotation of the upper stick portion 12 with respect to the middle stick portion 18. For example, the third bushing portion 36 may have a third bushing surface 36*a* configured to slidably engage with a fourth bushing surface 38*a* on the fourth bushing portion 38.

Generally, the bushing portions 32, 34, 36 and 38 may be made of any suitable material, such as a friction reduced plastic (e.g. Teflon™ or ultra high molecular weight polyethylene (UHMW PE)).

As shown in FIG. 7, in some embodiments the first and second bushing portions 32, 34 may be separated by a small gap G. In other embodiments, the first and second bushing portions 32, 34 may be engaged directly against each other with no gap therebetween.

In some embodiments, no bushing portions may be provided on the hockey stick 10. In other embodiments, a single bushing portion may be provided for each coupling joint 21 without a corresponding bushing on the opposing side. For example, the lower insert 24 may include the friction-reduced first bushing portion 32 that engages against the middle stick portion 18 or against the first coupling guide 26 without the second bushing portion 34.

Figure 4:
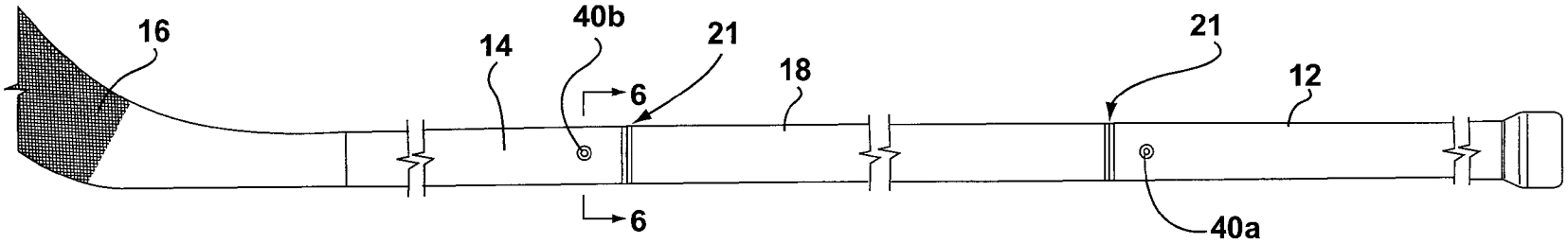
FIG. 4 is a side view of the hockey stick of FIG. 1.
Figure 5:
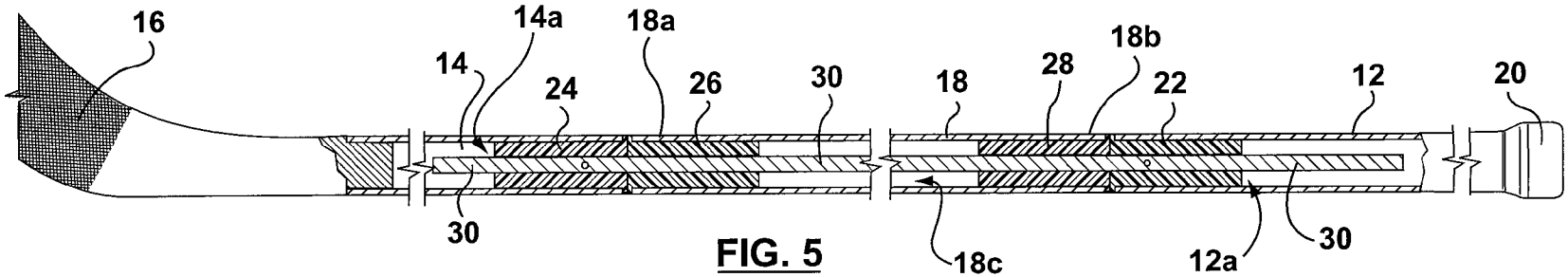
FIG. 5 is a partial cut-out side view of the hockey stick as shown in FIG. 4.

In some embodiments, at least one of the upper insert 22, the lower insert 24, the first coupling guide 26 and the second coupling guide 28 may be removably secured to the upper stick portion 12, the lower stick portion 14, and the middle portion 18, respectively. For example, as shown in FIGS. 3, 4 and 6, the upper insert 22 may be removably secured to the upper stick portion 12 using a first fastener 40*a*, and the lower insert 24 may be removably secured to the lower stick portion 14 using a second fastener 40*b*. The first and second fasteners 40*a*, 40*b* may be any suitable fastener, for example a screw, bolt, or nail.

Figure 8:
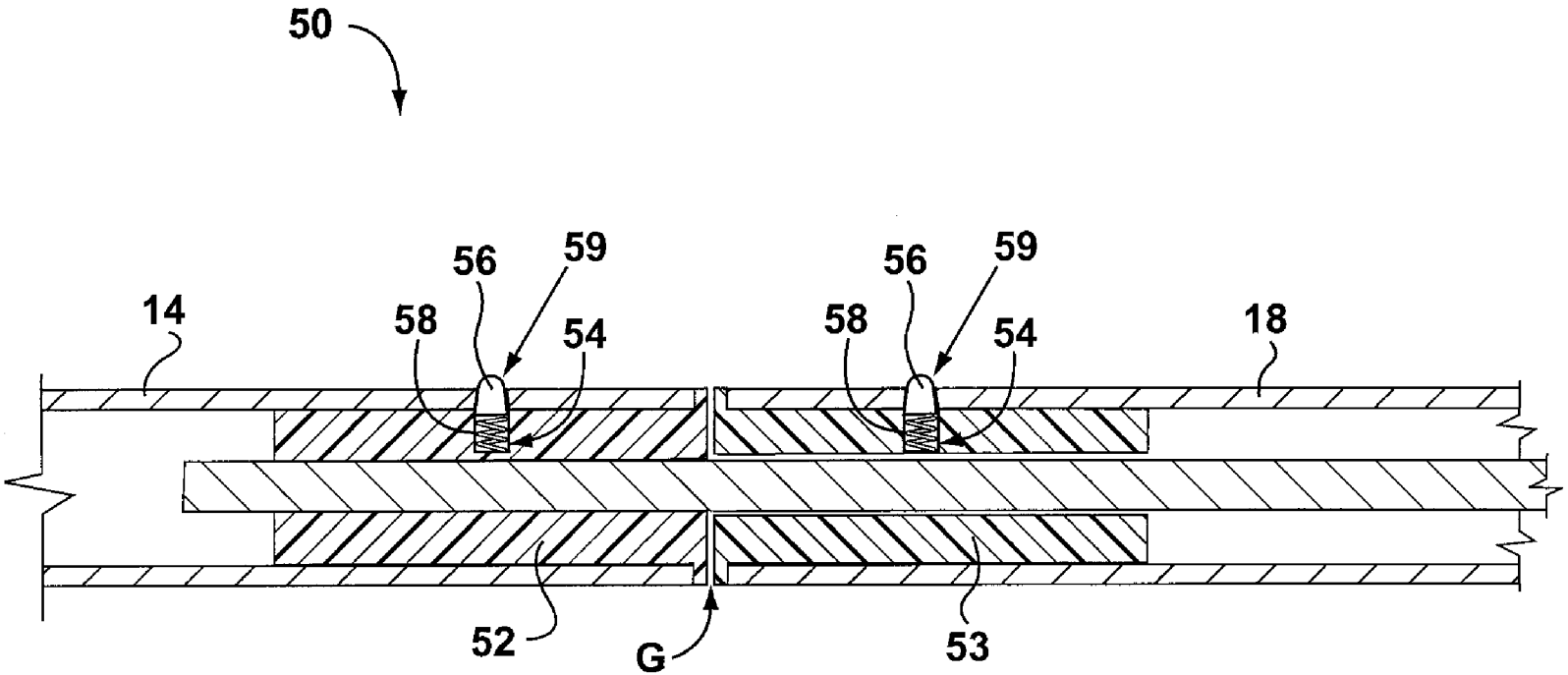
FIG. 8 is a close up detail view of a middle stick portion and a lower stick portion of a hockey stick according to another embodiment.

In other embodiments, locking pin mechanisms may be used to secure the inserts 22, 24 and coupling guides 26, 28 to the stick portion 12, 14, 18. For example, illustrated in FIG. 8 is a close up sectional view of a hockey stick 50 according to another embodiment of the invention. The hockey stick 50 is generally similar to the hockey stick 10, and like features are identified by like reference characters.

As shown, the lower stick portion 14 of the hockey stick 50 includes a lower insert 52 that is coupled to the lower stick portion 14 via a locking pin mechanism 54. Similarly, the middle stick portion 18 has a coupling guide 53 coupled thereto also using a locking pin mechanism 54. Each locking pin mechanism 54 generally includes a pin member 56 mounted on a spring member 58 such that the pin member 56 may be removably received in a bore 59 in the lower stick portion 12 and/or the middle stick portion 18. By depressing the pin members 56, the lower insert 52 and the coupling guide 53 may be removed from the lower stick portion 14 and middle stick portion 18, respectively.

In some embodiments, when the upper insert 22, the lower insert 24, the first coupling guide 26 and the second coupling guide 28 are removable, they may be replaced or repaired due to damage or wear resulting from use of the hockey stick 10.

Furthermore, in some embodiments, the removable inserts 22, 24 and coupling guides 26, 28 may allow the upper stick portion 12, lower stick portion 14 and/or the middle stick portion 18 to be changed. For example, the middle stick portion 18 could be replaced with a different middle stick portion that has a different length (e.g. to accommodate a person of smaller stature who wants to use the stick 10). Similarly, the lower stick portion 14 could be changed (e.g. to replace a right-handed blade member 16 with a left-handed or a straight blade member, or to replace the lower stick portion 14 with a goalie blade member).

In other embodiments, one or more of the upper and lower inserts 22, 24 and the first and second coupling guides 26, 28 may be permanently secured to the lower stick portion 14, the upper stick portion 12 and the middle stick portion 18. For example, in some embodiments the upper and lower inserts 22, 24 may be hot melted or glued to the upper and lower stick portions 12, 14, respectively. Similarly, in some embodiments, the first and second coupling guides 26, 28 may be hot melted or glued to the middle stick portion 18.

In other embodiments, one or more of the upper and lower inserts 22, 24 and the first and second coupling guides 26, 28 may be permanently secured to the lower stick portion 14, the upper stick portion 12 and the middle stick portion 18 by press fitting. For example, the upper insert 22 may be sized slightly larger that the upper hollow portion 12*a* of the upper stick portion 12 such that when the upper insert 22 is inserted therein, sufficient frictional forces are generated between the upper insert 22 and upper stick portion 12 so as to generally retain the upper insert 22 therein.

In some embodiments, the fasteners 40*a*, 40*b* may be non-removable fasteners (e.g. rivets), in which case the upper and lower inserts 22, 24 may not be removable. In other embodiments, other suitable techniques may be used for securing the inserts 22, 24 and the coupling guides 26, 28 to the stick members 12, 14, 18.

Figure 9:
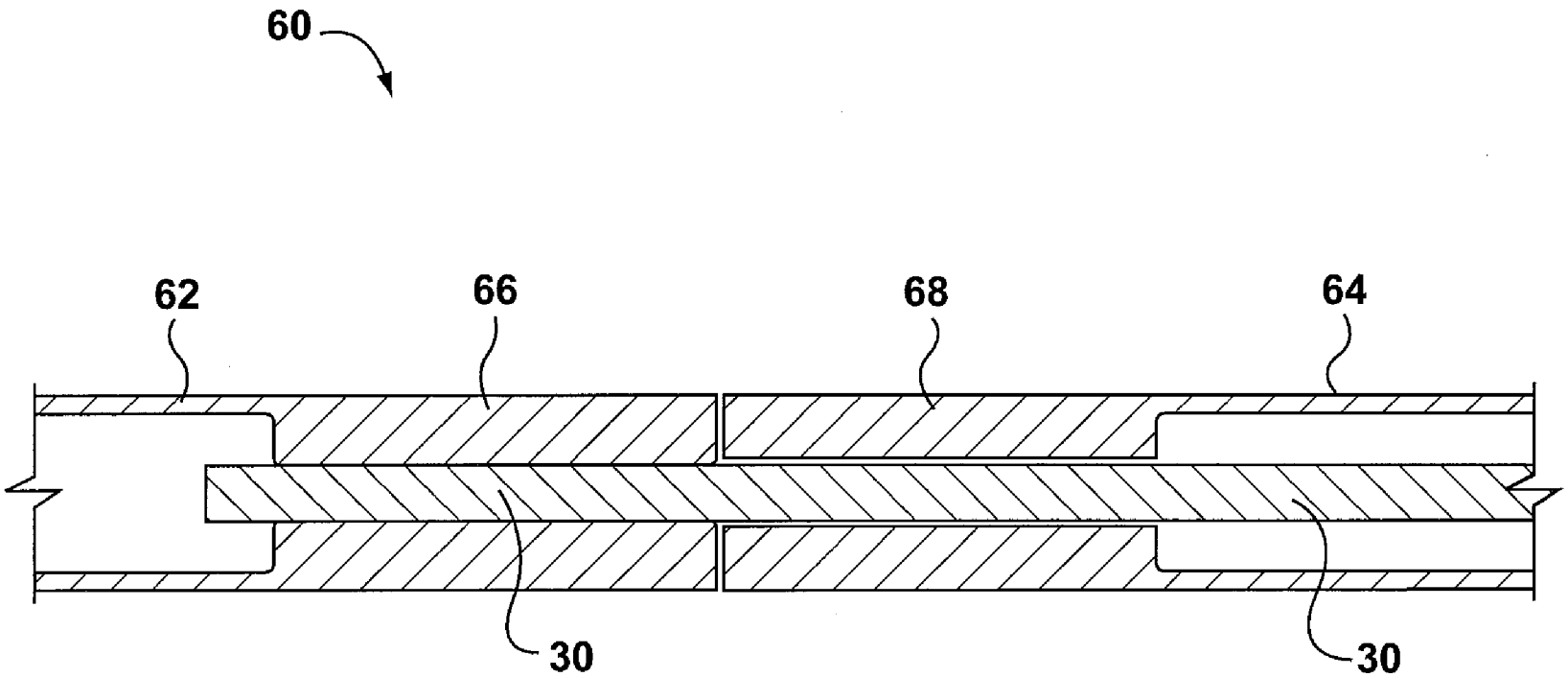
FIG. 9 is a close up detail view of a middle stick portion and a lower stick portion of a hockey stick according to another embodiment.

Turning now to FIG. 9, illustrated therein is a close up cross-sectional view of a hockey stick 60 according to yet another embodiment. The hockey stick 60 is generally similar to the hockey stick 10 described above, and like features are identified by like reference characters.

The hockey stick 60 generally includes a lower stick portion 62 similar to the lower stick portion 14 and a middle stick portion 64 similar to the middle stick portion 18, and has a coupling member 30 for rigidly coupling the lower stick portion 62 to an upper stick portion (not shown). However, in this embodiment, the lower insert and upper insert are formed as integral components of the lower stick portion 62 and upper stick portion. For example, the lower stick portion 62 has a lower insert 66 that is integral therewith. Furthermore, in this embodiment the coupling guides are formed as part of the middle stick portion 64. For example, as shown, the middle stick portion 64 has a first coupling guide 68 that is integral therewith.

The lower stick portion 62 and lower insert 66 and the middle stick portion 64 and the coupling guide 68 may be formed according to any suitable technique. For example, where the hockey stick 60 is made of a composite material, the lower insert 66 may be formed integrally with the lower stick portion 62 by molding the lower insert 66 and lower stick portion 62 together. Similarly, the coupling guide 68 may be formed integrally with the middle stick portion 64 such as by molding the coupling guide 68 and the middle stick portion 64 together.

Similarly to as described above, the coupling member 30 may be rigidly secured to the lower insert portion 66 in any suitable manner (e.g. using a fastener, adhesive, by press-fitting, etc.), while the coupling member 30 is rotatably engaged with the coupling guide portion 68.

Figure 10:
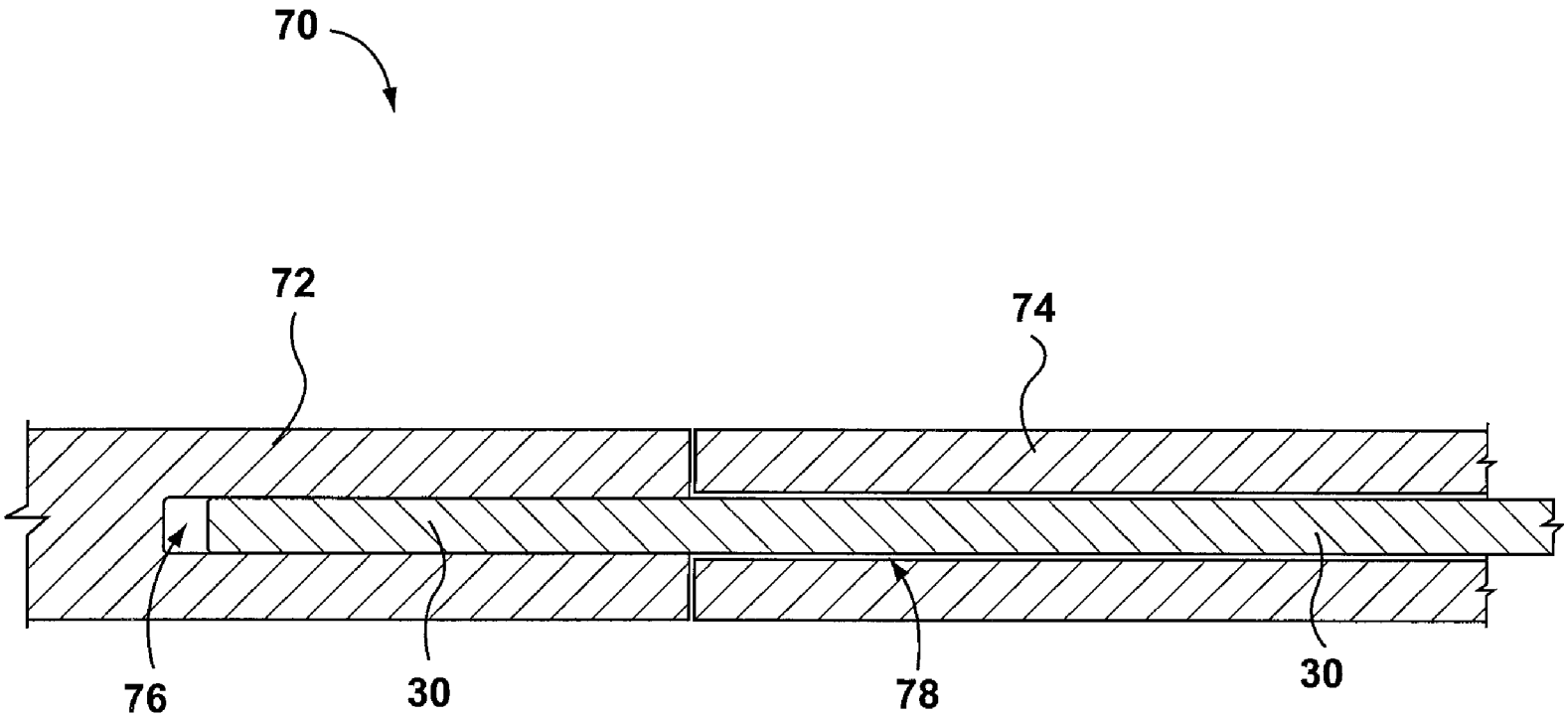
FIG. 10 is a close up detail view of a middle stick portion and a lower stick portion of a hockey stick according to yet another embodiment.

Turning now to FIG. 10, illustrated therein is a close up cross-sectional view of a hockey stick 70 according to yet another embodiment. The hockey stick 70 is generally similar to the hockey stick 10 described above, and like features are identified by like reference characters.

In this embodiment, the hockey stick 70 has a generally solid (e.g. non-hollow) lower stick portion 72 and a generally solid (e.g. non-hollow) middle stick portion 74. The lower stick portion 72 has a first bore 76 therein, and acts as a lower insert sized and shaped to rigidly receive the coupling member 30 (e.g. by press-fitting, or using adhesives, fasteners, etc). Similarly, the middle stick portion 74 has a second bore 78, and acts as a coupling guide sized and shaped such that the coupling member 30 may be rotatably engaged with the middle stick portion 74.

For example, where the hockey stick 70 is made of wood or a solid material (e.g. plastic, composite, etc.), the hockey stick 70 may be formed by drilling the first and second bores 76, 78, rigidly securing the coupling member 30 to the lower stick portion 72, and then sliding the second bore 78 of the middle stick portion 74 onto the coupling member 30. An upper stick portion (not shown) may then be secured to the stick 70 in a similar manner.

Figure 11:
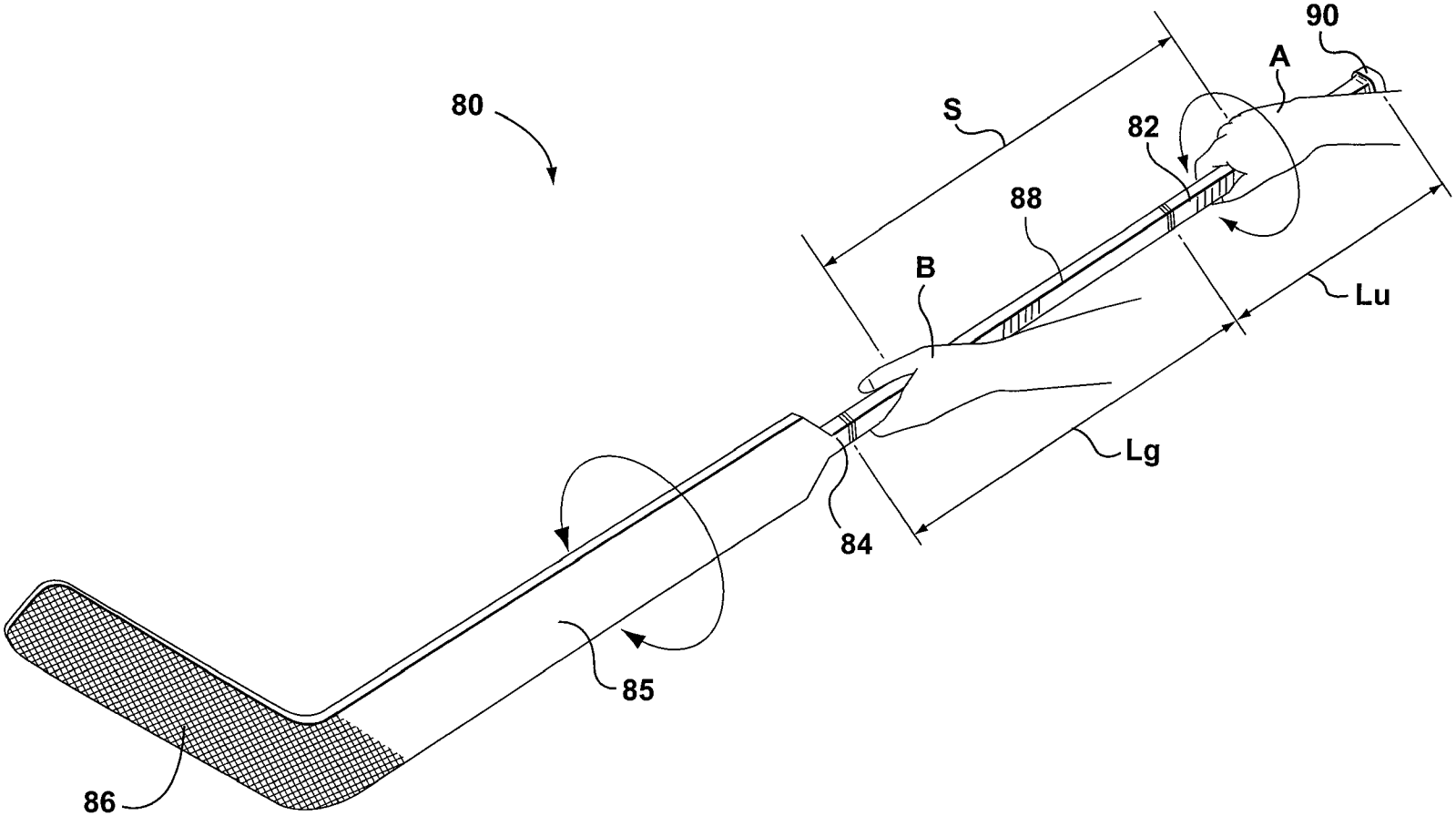
FIG. 11 is a perspective view of a hockey stick according to yet another embodiment wherein the hockey stick has a goalie stick shape.

Turning now to FIG. 11, illustrated therein is a hockey stick 80 according to yet another embodiment of the invention. The hockey stick 80 is generally similar to the hockey stick 10 described above but is shaped as a goalie stick. The hockey stick 80 may be used, for example, to train goalies in proper stick handling techniques.

The hockey stick 80 includes an upper stick portion 82 having a length Lu, a lower stick portion 84 having a widened blade region 85 and blade member 86 extending outwardly therefrom, and a middle stick portion 88 having a length Lg and being generally positioned between and collinear with the upper stick portion 82 and the lower stick portion 84.

As above, the lower stick portion 84 and the upper stick portion 82 are rigidly coupled together, while the middle stick portion 88 is rotatably coupled thereto. Accordingly, a person can use their control hand A to rotate the upper stick portion 82 of the hockey stick 10 causing the lower stick portion 84 and the blade member 86 to rotate, while the middle stick portion 88 may be inhibited from rotating using the directional hand B.

It will appreciated that the embodiments describe herein are not limited to ice hockey sticks used for training stick handling of a puck. In particular, one or more of the hockey sticks and training methods described herein may be used for example to train stick handling of other game elements, such as a ball for ball hockey. In other embodiments, one or more of the hockey sticks and training methods described herein may be used for example to train field hockey players or roller hockey players.

While the above description provides examples of one or more methods and apparatuses for stick handling training, it will be appreciated that other methods and apparatuses may be within the scope of the present description as interpreted by one of skill in the art.

The invention claimed is:

1. A hockey stick for training a person in stick handling, comprising:

a. an elongate upper stick portion configured to be gripped by a control hand of the person;

b. an elongate lower stick portion having a blade member extending outwardly therefrom;

c. an elongate coupling member rigidly coupling the upper stick portion to the lower stick portion; and d. an elongate middle stick portion positioned between and collinear with the upper stick portion and the lower stick portion and configured to be gripped by a directional hand of the person, the middle stick portion being rotatably coupled to the elongate coupling member so that rotation of the upper stick portion causes the lower stick portion and the blade member to rotate without rotating the middle stick portion gripped by the directional hand;

e. wherein the upper stick portion has an upper insert therein configured to securely engage a first end of the coupling member, and the lower stick portion has a lower insert therein configured to securely engage a second end of the coupling member so as to rigidly couple the upper stick portion to the lower stick portion.

2. The hockey stick of claim 1, wherein the upper stick portion and the middle stick portion are sized and shaped such that the control hand and the directional hand may be spaced apart by an operational distance during use.

3. The hockey stick of claim 2, wherein the operational distance is greater than about 6 inches.

4. The hockey stick of claim 1, wherein the upper stick portion and the middle stick portion each have generally matching rectangular outer stick profiles.

5. The hockey stick of claim 1, wherein the middle stick portion comprises at least one coupling guide sized and shaped to rotatably engage the coupling member therein.

6. The hockey stick of claim 5, wherein:

a. the lower insert has a first friction-reduced bushing portion protruding outwardly from the lower stick portion; and b. the at least one coupling guide comprises a first coupling guide having a second friction-reduced bushing portion protruding outwardly from the lower end of the middle stick portion;

c. wherein the first and second bushing portions are configured to slidably engage with each other to facilitate rotation of the lower stick portion with respect to the middle stick portion.

7. The hockey stick of claim 5, wherein:

a. the upper insert has a third friction-reduced bushing portion protruding outwardly from the upper stick portion; and b. the at least one coupling guide comprises a second coupling guide having a fourth friction-reduced bushing portion protruding outwardly from the upper end of the middle stick portion;

c. wherein the third and fourth bushing portions are configured to slidably engage with each other to facilitate rotation of the upper stick portion with respect to the middle stick portion.

8. The hockey stick of claim 1, wherein the lower insert is permanently secured to the lower stick portion and the upper insert is permanently affixed to the upper stick portion.

9. The hockey stick of claim 1, wherein the lower insert is removably secured to the lower stick portion and the upper insert is removably secured to the upper stick portion.

10. The hockey stick of claim 1, wherein the upper insert is integral with the upper stick portion, and the lower insert is integral with the lower stick portion.

11. The hockey stick of claim 10, wherein the middle stick portion further comprises at least one coupling guide integral therewith, the at least one coupling guide being sized and shaped to rotatably engage the coupling member therein.

12. The hockey stick of claim 1, wherein the upper stick portion has an upper gripping portion configured to receive the control hand, and the middle stick portion has a middle gripping portion configured to receive the directional hand, the upper and middle gripping portions sized and shaped such that the control hand and the directional hand may be spaced apart by an operational distance during use.

13. The hockey stick of claim 1, wherein the coupling member is a rod member having at least one portion with a cylindrical outer profile.

14. The hockey stick of claim 1, wherein the middle stick portion is at least 12 inches long, and the upper stick portion is at least 4 inches long.

15. A rotational assembly for use with a hockey stick, comprising:

a. a lower insert sized and shaped to be received in a first hollow portion of a lower stick portion of the hockey stick;

b. an upper insert sized and shaped to be received in a second hollow portion of an upper stick portion of the hockey stick;

c. an elongate coupling member rigidly coupled to the lower insert and the upper insert; and d. an elongate middle stick portion rotatably coupled to the coupling member so that, when the upper insert is received in the upper stick portion and the lower insert is received in the lower stick portion, rotation of the upper stick portion causes the lower stick portion to rotate without rotating the middle stick portion.

16. The rotational assembly of claim 15, wherein the middle stick portion comprises at least one coupling guide sized and shaped to rotatably engage the coupling member therein.

17. The rotational assembly of claim 16, wherein:

a. the lower insert has a first friction-reduced bushing portion protruding outwardly from the lower stick portion; and b. the at least one coupling guide comprises a first coupling guide having a second friction-reduced bushing portion protruding outwardly from the lower end of the middle stick portion;

c. wherein the first and second bushing portions are configured to slidably engage with each other to facilitate rotation of the lower stick portion with respect to the middle stick portion.

18. The rotational assembly of claim 17, wherein:

a. the upper insert has a third friction-reduced bushing portion protruding outwardly from the upper stick portion; and b. the at least one coupling guide comprises a second coupling guide having a fourth friction-reduced bushing portion protruding outwardly from the upper end of the middle stick portion;

c. wherein the third and fourth bushing portions are configured to slidably engage with each other to facilitate rotation of the upper stick portion with respect to the middle stick portion.

19. The hockey stick of claim 15, wherein the lower insert is permanently secured to the lower stick portion and the upper insert is permanently affixed to the upper stick portion.

20. The hockey stick of claim 15, wherein the upper insert is integral with the upper stick portion, and the lower insert is integral with the lower stick portion.

* * * * *